United States Patent [19]

Ott

[11] 4,433,604

[45] Feb. 28, 1984

[54] FREQUENCY DOMAIN DIGITAL ENCODING TECHNIQUE FOR MUSICAL SIGNALS

[75] Inventor: Granville E. Ott, Lubbock, Tex.

[73] Assignee: Texas Instruments, Dallas, Tex.

[21] Appl. No.: 304,470

[22] Filed: Sep. 22, 1981

[51] Int. Cl.[3] ..... G10H 1/02

[52] U.S. Cl. ..... 84/1.19; 84/1.24; 84/DIG. 9; 364/726

[58] Field of Search ..... 84/1.01, 1.19, 1.24, 84/DIG. 9; 179/1 S A; 364/726, 724

[56] References Cited

U.S. PATENT DOCUMENTS 4,066,842 1/1978 Allen ..... 179/1 SA 4,231,277 11/1980 Wachi ..... 84/1.19

*Primary Examiner*—Isen, F. W.

*Attorney, Agent, or Firm*—Robert D. Marshall; Leo N. Heiting; Mel Sharp

[57] ABSTRACT

An apparatus for encoding and decoding musical signals in digital form employs conversion to the frequency domain. Discrete Fourier transform coefficients are calculated from time domain digital data at selected frequencies which are organized in sets of octavely related frequencies. Selecting frequencies in this manner greatly reduces the data rate by eliminating coefficients for many higher frequencies without a great loss of fidelity because the provision of a predetermined number of frequencies in each octave approximates the tonal response of the human ear. A further refinement is selection of frequencies to correspond to the frequencies of musical notes where the greatest energy can be expected. The complex number discrete Fourier transform coefficients can be converted to polar form with logarithmic magnitude values resulting in a further data rate reduction because the human ear is responsive only to logarithmic amplitude and because the human ear is relatively insensitive to phase angle enabling fewer bits to be used to represent the angular part without loss of fidelity. A digital filter can be easily implemented by manipulation of the magnitude part of the discrete Fourier transform coefficients.

40 Claims, 13 Drawing Figures

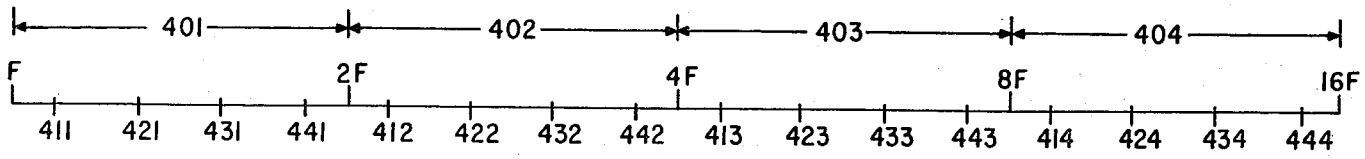
Fig. 8
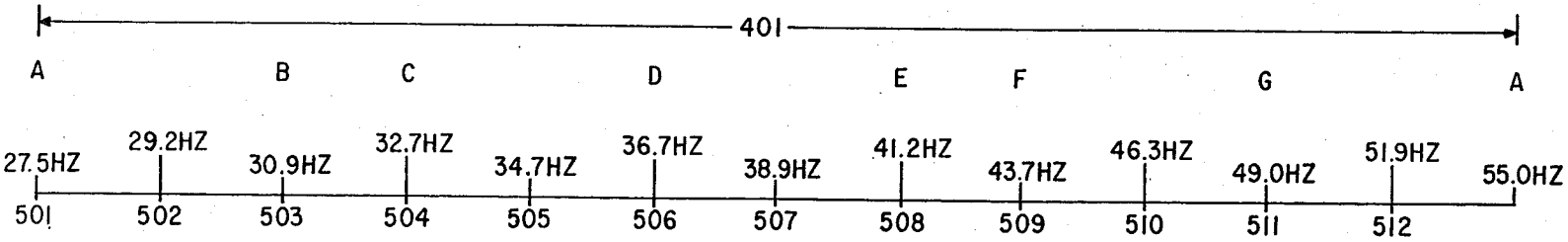
Fig. 9
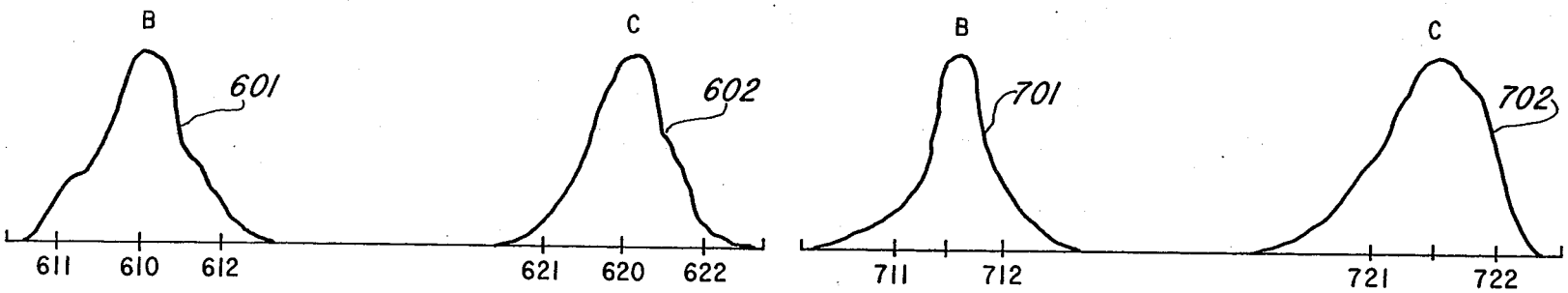
Fig. 10
Fig. 11

FREQUENCY DOMAIN DIGITAL ENCODING TECHNIQUE FOR MUSICAL SIGNALS

BACKGROUND OF THE INVENTION

The present invention relates to digital encoding of musical signals for transmission and storage. Employing a digital transmission or storage medium for musical signals is advantageous over the older known analog transmission and storage techniques due to increased noise immunity. That is, when digital transmission and storage techniques are employed the inherent noise in the transmission medium or in the memory medium causes a much smaller adverse effect on the ultimate reproduced musical signal than in the case of analog systems.

A typical proposed digital musical encoding system known in the prior art employs an analog-to-digital converter to convert an analog input signal corresponding to musical signals into a series of digital words. Each digital word typically includes 14 to 16 bits which represent the amplitude of the analog signal at a particular point in time. According to the well known Nyquist sampling theorem, the rate at which the analog signal is sampled for generation of the digital data words must be at least twice the highest frequency to be handled by the system. Thus in a typical musical system in which the highest desired frequency to be reproduced is in the range of 15 KHz to 20 KHz, the sampling rate must be at least 30 KHz to 40 KHz.

This known prior system has a marked disadvantage in that the data rates required for the communication of the musical signals and the data storage capacity necessary for storing these musical signals in digital form is much greater than the similar data communications rate and storage requirements in analog form. For example, selecting a sampling rate of 44 KHz and a 14 bit sample size, a stereo system employing two channels would require 1.23 million bits per second. Under similar conditions employing a 16 bit sample would require 1.4 million bits per second. This data rate requirement, and the corresponding storage requirements, far exceed the current capacity of analog musical systems. As a consequence, digital musical transmission and storage systems of this type have typically specified use of video storage techniques such as video disks or video cassette recorders in order to obtain the required data rate and storage capacity. As a consequence the cost and complexity of such systems greatly exceeds that of the analog systems to be replaced.

SUMMARY OF THE INVENTION

It is an object of the present invention to provide a method for communicating and storing digital representations of musical signals in a manner which greatly reduces the data rate and storage requirements. This technique is described in conjunction with a system which receives an analog musical signal, converts it into digital data in accordance with the principles of the invention, communicates this digital data to a unit which reconverts this digital data into analog form. In accordance with another described aspect of this invention, an analog musical signal is received and converted into digital data in accordance with the principles of the present invention and stored in a digital data memory. This digital data memory may then be connected to a companion unit which reads out the digital data stored therein, converts it back into its analog form and then outputs the analog musical signal.

It is another object of the present invention to provide a simplified means for frequency filtering of the musical signal by taking advantage of the form of the digital representation of the musical signal.

In accordance with one embodiment of the present invention, the analog musical signal is converted into a series of digital data words representative of the amplitude of the analog musical signal at a plurality of repetitive sampling intervals. This set of data words, organized in a manner referred to as the time domain, is converted into the frequency domain in accordance with the well known Fourier transformation. In accordance with the principles of the present invention, discrete Fourier transform coefficients are calculated from the time domain digital data words for at least one set of frequencies. Each of these set of frequencies includes a primary frequency and at least one frequency octavely related to the primary frequency.

In accordance with a further aspect of the present invention, the sets of frequencies are selected so that the primary frequency of each set is spaced at equal percentage frequency intervals throughout a primary octave. In a further aspect of the present invention, these primary frequencies each correspond to a different selected musical note. In accordance with another aspect of the present invention a plurality of primary frequencies is disposed within a predetermined frequency range of each musical note of the primary octave.

In a further embodiment of the present invention, the discrete Fourier transform coefficients at the selected frequencies, which are complex numbers, are converted from rectangular form having a real part and a imaginary part into polar form having a magntiude part and an angle part. Because it has been found that the human ear is less sensitive to the angle part of the information that to the magnitude part, the angle part may be represented by fewer bits than the magnitude part. In a further aspect of this invention, in order to further reduce the data rate without significant loss of information, the magnitude part of the complex number discrete Fourier transform coefficient is converted into logarithmic form.

In a further embodiment of the present invention, a frequency filter is achieved by modifying the magnitude part of the complex number discrete Fourier transform coefficients by an amount associated with the corresponding frequency. In the case of linear magnitude parts, this modification can be achieved by multiplication of each magnitude part of a coefficient corresponding to the filter value for the associated frequency. In the case of logarithmic magnitude parts, this may be achieved by addition of a predetermined number selected according to the corresponding frequency to each magnitude part.

BRIEF DESCRIPTION OF THE DRAWINGS

The above and other objects and aspects of the present invention will become clear from the detailed explanation below taken in conjunction with the drawings in which:

FIG. 8 illustrates a frequency spectrum including one embodiment of the selected frequencies from the Fourier transform means;

FIG. 9 illustrates a frequency spectrum in accordance with another embodiment of the present invention in which the selected frequencies of the Fourier transform means correspond to musical notes;

FIG. 10 illustrates a portion of a frequency spectrum in which two frequency samples of the Fourier transform means fall within the envelope corresponding to each musical note;

FIG. 11 illustrates a portion of a frequency spectrum in which three selected frequencies of the Fourier transform means are included within the envelope associated with each musical note;

DETAILED DESCRIPTION OF THE PREFERRED EMBODIMENTS

Figure 1:
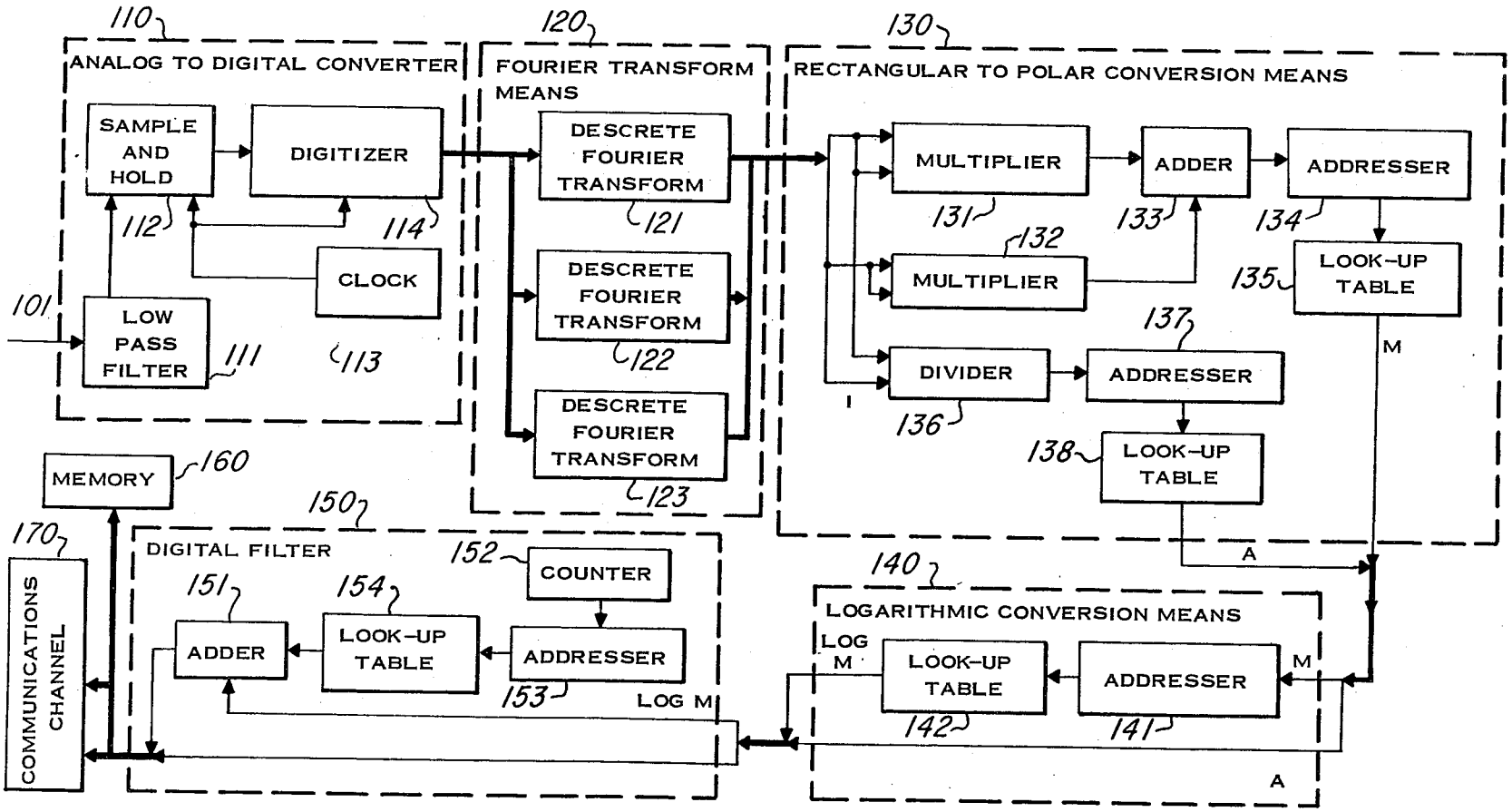
FIG. 1 is a block diagram illustrating an encoding apparatus in accordance with the teachings of the present invention.
Figure 5:
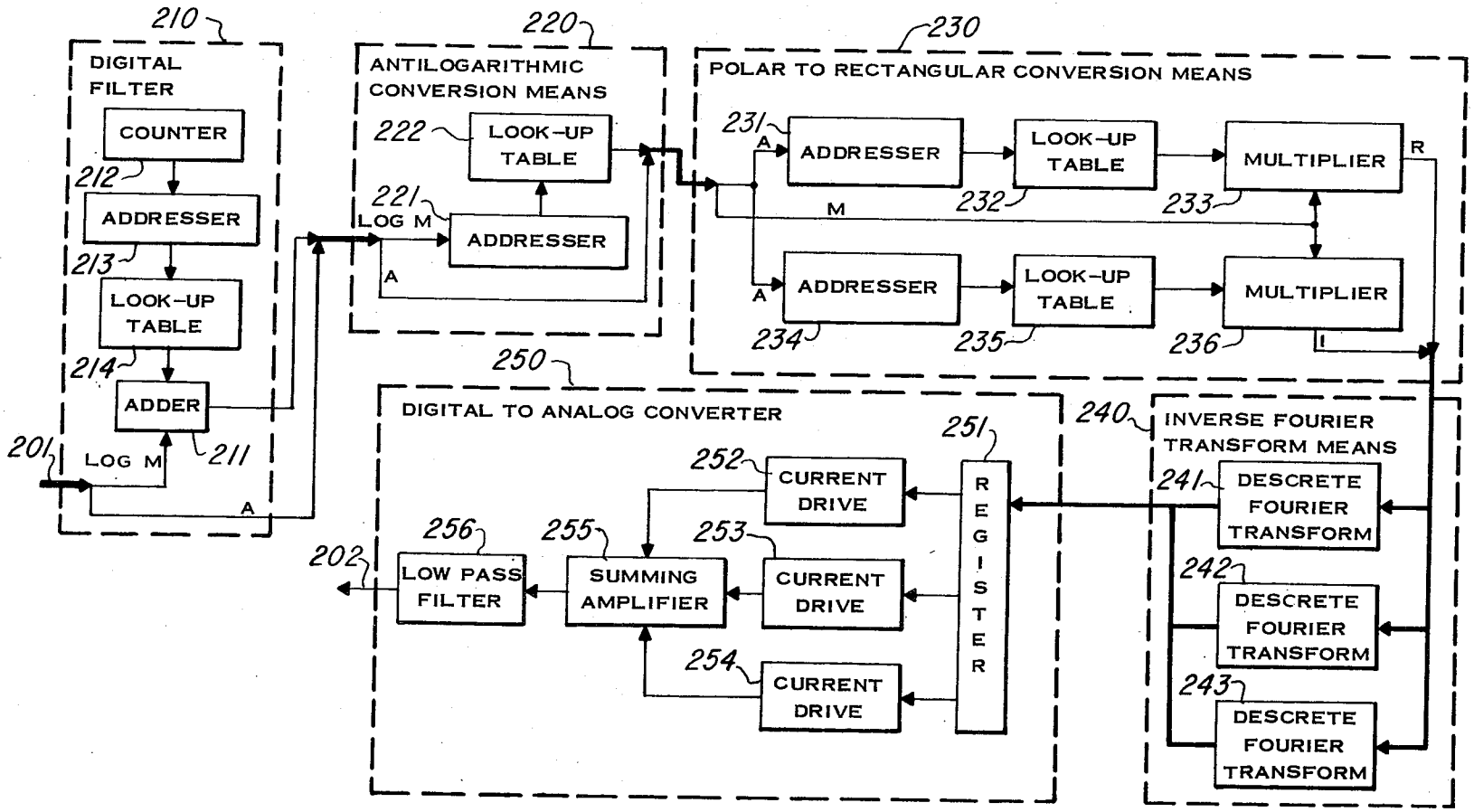
FIG. 5 is a block diagram illustrating a decoding apparatus in accordance with the teachings of the present invention.

The details of the present invention will now be described in conjunction with the drawings. FIG. 1 illustrates a preferred embodiment of an encoding apparatus in accordance with the teachings of the present invention. FIG. 5 illustrates a preferred embodiment of a decoding apparatus in accordance with the teachings of the present invention. In a system in which musical signals are communicated via some communications channel, the apparatus illustrated in FIG. 1 would be located at the transmitting station and the apparatus illustrated in FIG. 5 would be located in the receiving station. In an embodiment in which musical signals are stored in some portable memory apparatus, such as an audio disk or some form of magnetically recordable medium such as disk, tape, or cassette, the system illustrated in FIG. 1 would be employed to encode the musical signals for application to the memory and the system illustrated in FIG. 5 would be employed for decoding the digital data read out from the portable memory.

FIG. 1 illustrates a preferred embodiment of the encoding apparatus 100 in accordance with the teachings of the present invention. Analog input signals are received via analog input 101 and applied to analog to digital converter 110. Analog to digital converter 110 generates a series of digital data words corresponding to the analog input. This series of digital data words from analog to digital converter 110 is applied to Fourier transform means 120. Fourier transform means 120 converts the time domain digital data from analog to digital converter 110 into frequency doman digital data at selected frequencies. This frequency domain digital data is applied to rectangular to polar conversion means 130. Rectangular to polar conversion 130 transforms the complex number discrete Fourier transform coefficients received from Fourier transform means 120 from rectangular form, which has a real part and an imaginary part, into polar form, which has a magnitude part and an angle part. This polar form complex number data is applied to logarithmic conversion means 140. Logarithmic conversion means 140 converts the magnitude part of the complex number data into logarithmic form. The thus converted polar form complex number data from logarithmic conversion means 140 is applied to digital filter 150. Digital filter 150 selectively modifies the magnitude part of each complex number coefficient. This modification is dependent upon the frequency of the particular complex number discrete Fourier transform coefficient, thereby achieving selective frequency filtering. The output complex number discrete Fourier transform coefficients from the digital filter 150 are applied alternately to a memory means 160 or a communications channel 170. Memory 160 stores these complex number discrete Fourier transform coefficients for later readout and use. Communications channel 170 transmits these complex number discrete Fourier transform form coefficients to another unit for reception and decoding.

Analog to digital converter means 110 operates to convert analog input data received on input 101 into a time series of digital data words. Analog to digital converter 110 includes low pass filter 111, sample and hold device 112, clock 113 and digitizer 114. Low pass filter 110 has a cut-off frequency equal to the highest frequency signal of interest in the expected input to input 101. In a typical system in which musical signals are applied to input 101, the cut-off frequency of low pass filter 111 would be in the region between 15 KHz and 20 KHz. Low pass filter 111 is employed to insure that no extraneous high frequency signals which would interfere with the reconstituted analog signal are applied to sample and hold device 112. Sample and hold device 112 receives the filtered output from low pass filter 111. At time intervals determined by clock 113 sample and hold device 112 periodically samples the amplitude of the analog signal applied thereto and holds this sample until the next sample is taken. Sample and hold device 112 would typically take the form of a gated amplifier which drives an output capacitor, the output capacitor being connected in a circuit whose time constant is relatively large compared to the sampling interval. The sampled magnitude signal from sample and hold device 112 is applied to digitizer 114 together with a signal from clock 113. Digitizer 114 then generates a digital data word having a value corresponding to the magnitude of the sampled signal.

Figure 2:
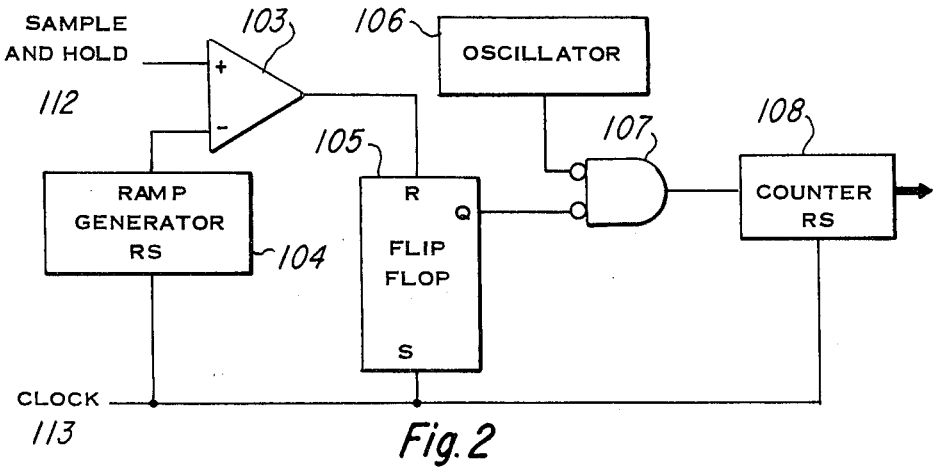
FIGS. 2, 3 and 4 are block diagrams illustrating alternative embodiments of the digitizer 114 illustrated in FIG. 1.
Figure 3:
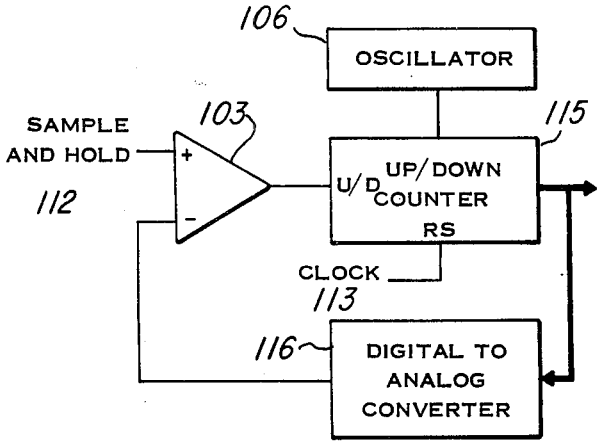
Figure 4:
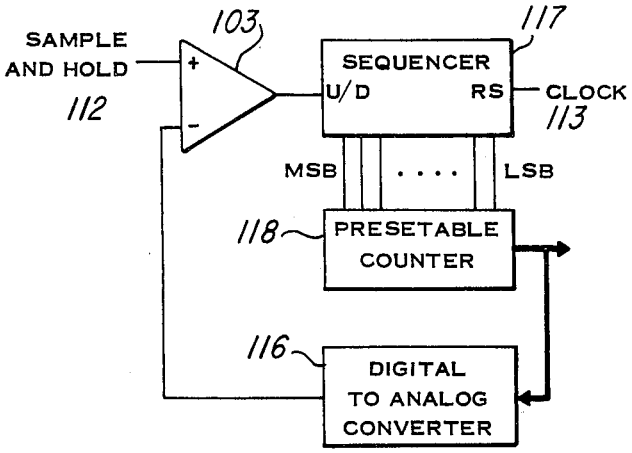

FIGS. 2, 3 and 4 illustrate alternative embodiments of digitizer 114 illustrated in FIG. 1. FIG. 2 illustrates a digitizer of the ramp voltage type. The sample voltage from sample and hold device 112 is applied to the noninverting input of comparator 103. The output of ramp voltage generator 104 is applied to the inverting input of comparator 103. A signal from clock 113 starts and resets ramp voltage generator 104 as well as setting flip flop 105. When set flip flop 105 places a logical high signal on one input of NOR gate 107. As a result NOR gate 107 acts as an inverter passing the signal from oscillator 106 to counter 108. The frequency of oscillator 106 is selected at a value much higher than the frequency of clock 113. When the voltage from ramp voltage generator 104, which starts at a low value and linearly increases, crosses the voltage from sample and hold device 112 the output of comparator 103 resets flip flop 105. As a consequence, NOR gate 107 no longer passes the output of oscillator 106 to counter 108. The count then stored in counter 108 is directly related to the time required for the voltage from ramp voltage generator 104 to reach the sampled voltage, and therefore is proportional to the sampled voltage. Counter 108 is reset and started by a signal from clock 113 so as to be in synchronism with the sample time of sample and hold device 112.

FIG. 3 illustrates a digitizer of the tracking counter type. The voltage from sample and hold device 112 is applied to the noninverting input of comparator 103. The outut of comparator 103 is applied to the up/down control input of an up/down counter 115. Up/down counter 115 is driven by oscillator 106. The output of up/down counter 115, which is the desired digital data word output, is applied to digital to analog converter 116. Digital to analog converter 116 generates an analog voltage proportional to the digital data word and applies this analog signal to the noninverting input of comparator 103. Digital to analog converter 116 may operate in a manner similar to that disclosed below in conjunction with the description of digital to analog converter 250. The system illustrated in FIG. 3 includes a feed back loop which causes the count stored in up/-down counter 115 to be proportional to the sampled voltage. If the count in up/down counter 115 is too low, digital to analog converter 116 generates an output signal less than the sampled voltage. In such a case comparator 103 causes up/down counter 115 to be in an up counting mode. On the other hand, if the count in up/down counter 115 is two great, the output from digital to analog converter 116 is greater than the sampled voltage. In this case the output of comparator 103 causes up/down counter 115 to be in a down counting mode. Thus the feedback loop causes up/down counter 115 to be counting in a direction toward the desired digital data word count. Up/down counter 115 is reset and started by a signal from clock 113 so as to be in synchronism with sample and hold device 112. Note that it is typical to include one additional bit in up/-down counter 115 than is required for the desired digital data word because the system illustrated in FIG. 3 will typically toggle the least significant bit between 1 and 0.

FIG. 4 illustrates a digitizer of the successive approximation type. The sample voltage from sample and hold device 112 is applied to the noninverting input of comparator 103. As in the example illustrated in FIG. 3, a digital to analog converter 116 supplies an analog voltage to the inverting input of comparator 103. The output of comparator 103 is applied to an up/down input of sequencer 117. Sequencer 117 presets the count in presetable counter 118 starting with the most significant bit and ending with the least significant bit. Initially the count stored in presetable counter 118 is all zero's and thus the output from digital to analog converter is less than the sampled voltage. The most significant bit is then set to 1, thereby causing digital to analog converter 116 to generate a voltage in the middle of the range controlled by the digital data word stored in presetable counter 118. If the voltage output from digital to analog converter 116 is still less than the sampled voltage, then the output from comparator 103 will remain unchanged and the required value of the most significant bit is one. If the output from digital to analog converter 116 is greater than the sampled voltage, the output from comparator 103 will reverse and therefore the most significant bit is a zero. Next the second most significant bit is set to 1 and comparison is again made via comparator 103 to determine whether the correct value for this bit is zero or 1. This process is continued throughout the entire range of bits of presetable counter 118 until each of these bits has been set in this manner. Sequencer 117 is reset and started by a signal from clock 113 so as to be in synchronism with sample and hold device 112.

The digital data words from analog to digital converter 110 are applied to Fourier transform means 120. Fourier transform means 120 converts the time domain data received from analog to digital converter means 110 into frequency domain data at a particular set of selected frequencies. Fourier transform means 120 includes a group of discrete Fourier transforms (DFT) represented by 121, 122, and 123. It is anticipated that such a group of discrete Fourier transforms means would be required due to the substantial computation requirements and the particular organization of the selected frequencies at which discrete Fourier transform coefficients are to be calculated. These discrete Fourier transforms would perform a fast Fourier transform on the time sampled data. A fast Fourier transform is a mathemetical technique which uses matrix mathematics to simplify the computation necessary to calculate Fourier transform coefficients from sampled time domain data. This mathematical technique is equally applicable to embodiments including dedicated hardware for data calculation and to embodiments which employ programmed digital computers. In the present use a set of digital data words corresponding to approximately 50 miliseconds of the analog input is applied to the input of the discrete Fourier transforms. In a typical prior art use the output of the discrete Fourier transforms would be a set of complex number discrete Fourier transform coefficients corresponding to a set of linearly spaced frequencies, the spacing corresponding to the inverse of the length of the data represented by the data blocks. Thus, for example, greater frequency resolution can be achieved by sampling longer blocks of data words, however, the amount of computation for obtaining this increased resolution frequency data is correspondingly increased. In the present use of the discrete Fourier transforms, complex number discrete Fourier transform coefficients are not calculated for each of these linearly spaced frequencies. On the contrary, a discrete Fourier transform coefficient is calculated only for a primary frequency that is the lowest frequency at which the particular discrete Fourier transform can resolve, this being related to the length of the data sample, and to frequencies which are octavely related to the primary frequency. Thus, the discrete Fourier transform coefficients would be calculated only for the primary frequency F and for frequencies fitting the form $2^nF$, where n is an integer. Calculation of discrete Fourier transform coefficients for only these frequencies is accomplished by modifying slightly the fast Fourier transform calculation method to omit matrix operations required for calculation of discrete Fourier transform coefficients corresponding to the other frequencies.

Fourier transform means 120 is illustrated as including a plurality of discrete Fourier transforms 121, 122, and 123, because it is contemplated that discrete Fourier transform coefficients will be calculated for several sets of octavely related frequencies. Thus each discrete Fourier transform will operate from a different number of consecutive time domain samples from analog to digital converter 110 in order to generate discrete Fourier transform coefficients for a set of frequencies with a primary frequency within a primary octave.

Figure 7:
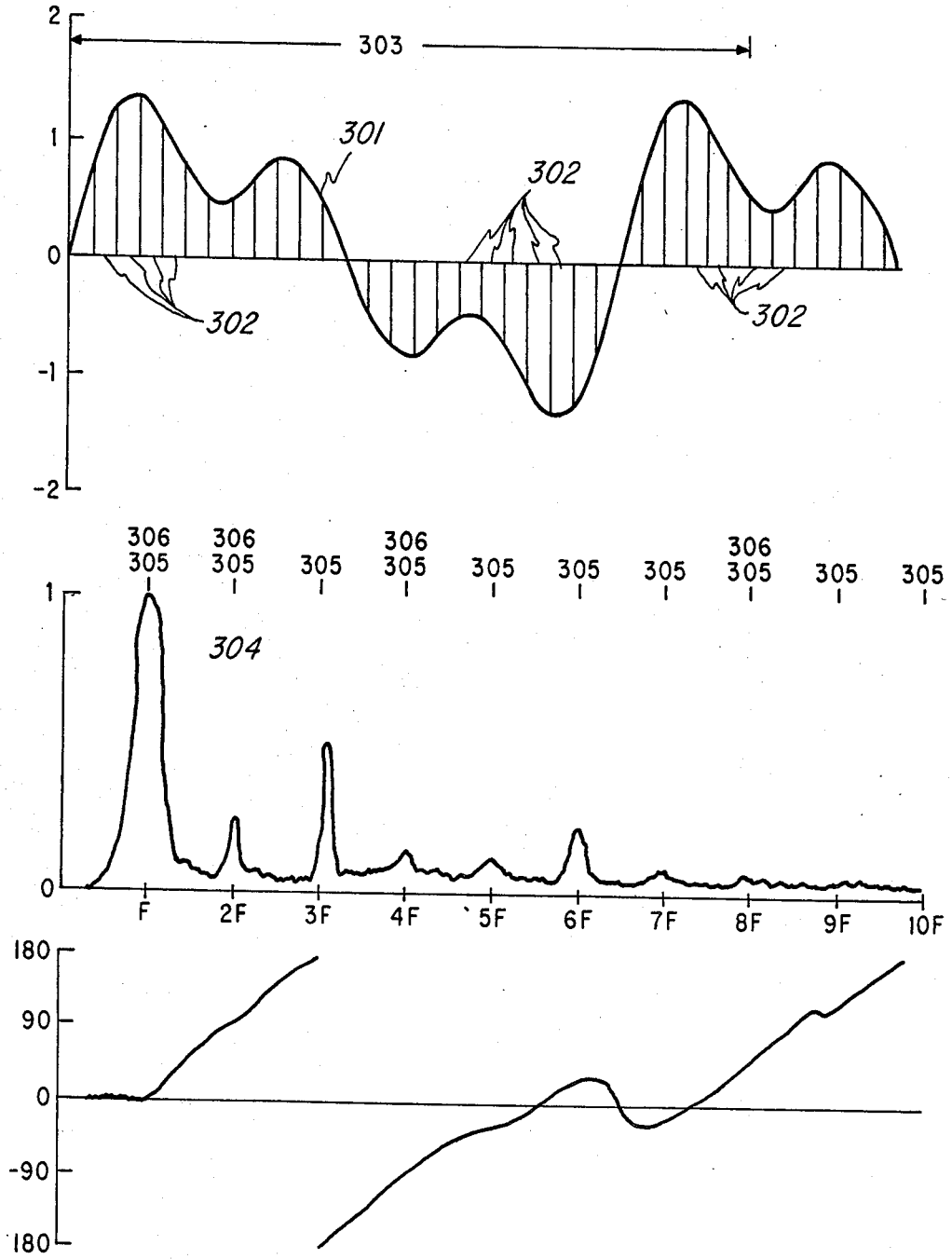
FIG. 7 illustrates signal diagrams of the same signal in both the time domain and the frequency domain.

The operation of the discrete Fourier transform means is illustrated generally in FIG. 7. Curve 301 corresponds to the musical signal applied to input 101, and is in the time domain. Analog to digital converter 110 generates digital data words corresponds to the amplitude of the curve 301 at the times indicated by samples 302. These digital data words are applied to the discrete Fourier transform means in sample groups as indicated by groups 303. As explained above, the length of the sample groups determines the resolution frequency of the resulting discrete Fourier transform. Curve 304 represents the Fourier transform of the analog wave form shown in curve 301, it being understood that curve 304 represents in the frequency domain the same information represented in the time domain in curve 302. Application of the sample groups 303 of samples 302 to the discrete Fourier transforms in accordance with the prior art would result in generation of plurality of discrete Fourier transform coefficients 305 which are separated in frequency by an amount the inverse of the length of time of the sample groups 303. Please note that each of these discrete Fourier transform coefficients is a complex number which corresponds to the frequency domain sample of the analog wave illustrated in 301 at the particular frequency. In accordance with the present invention, only a subset of these discrete Fourier transform coefficients are calculated. This subset is illustrated by selected frequencies 306. In accordance with the teachings of the present invention selected frequencies 306 include a number of primary frequencies, and a group of frequencies octavely related to each primary frequency.

The complex number discrete Fourier transform coefficients at the selected frequencies generated by Fourier transform means 120 are applied to rectangular to polar conversion means 130. It should be noted that the complex numbers generated by Fourier transform means 120 are in rectangular form. That is, each of these complex numbers is represented by a real part and an orthoginal imaginary part. Rectangular to polar conversion means 130 translates each of these complex number coefficients from rectangular notation into polar notation. In polar notation each of these complex numbers has a magnitude part and an angle part. The rectangular form complex number is converted into a polar form complex number in accordance with the following formulas;

$$M = \sqrt{(R^2 + I^2)}$$

$$A = \arctan (I/R)$$

A=arctan (I/R)

where M is the magnitude part and A is the angle part of the polar form notation, and R is the real part and I is the imaginary part of the rectangular form notation.

Rectangular to polar conversion means 130 includes multipliers 131 and 132, adder 133, addressing means 134, square root look-up table 135, divider 136, addressing means 137, and arc tangent look-up table 138. When each complex number discrete Fourier transform coefficient is received by rectangular to polar conversion means 130 the real part R is applied to both inputs of multiplier 131 to calculate $R^2$. Similarly, the imaginary part I is applied to both inputs of multiplier 132 to calculate $I^2$. The outputs of multipliers 131 and 132 are applied to the two inputs of adder 133. The result of this addition is applied to addressing means 134 for determining the data to be read out of square root look-up table 135. Specifically, addressing means 134 generates an address in accordance with the signal received from adder 133 which accesses the data value from square root look-up table 135 in order to read out the square root of the number applied to addressing means 134. Addressing means 134 may include some form of rounding in order to access the nearest square root value stored in square root look-up table 135 in the event that the output from adder 133 does not correspond exactly to one of the square root values stored in square root look-up table 135. The square root value output from square root look-up table 135 corresponds to the magnitude part of the complex number.

The angle part of the polar form complex number is calculated using divider 136, addressing means 137 and arc tangent look-up table 138. Imaginary part I and real part R are applied to divider 136 to generate I/R. This result is applied to addressing means 137 which controls the read out of data from arc tangent look-up table 138 in a manner similar to the cooperation of addressing means 134 and square root loop-up table 135. That is, addressing means 137 selects an address from arc tangent look-up table 138 which has data stored therein corresponding to the arc tangent of the number output from divider 136. The output of arc tangent look-up table 138 thus is the angle part of the polar form complex number. As noted below, it is anticipated that the angle part of the polar form complex number coefficient will be represented by fewer bits than employed to represent either the magnitude part of the polar form complex number or either of the real or imaginary parts of the rectangular form complex number coefficient. For this reason, the angle part is quantized in relatively large steps, and therefore it is not necessary to perform a precise calculation in order to select the proper angle part. Firstly, the sign bits of the real and imaginary parts correspond directly to the quandrant at which the angle part lies and therefore the two most significant bits of the angle part. In addition, the division taking place in divider 136 may be performed on just a few of the most significant bits of the imaginary part I and real part R without affecting the selected angle part. Alternatively, the absolute magnitude of the most significant bits of the imaginary part I and the real part R may be compared to derive the least significant bits of the angle part. Use of either of these schemes or other equivalent schemes may reduce the amount of computation necessary to calculate the angle part.

The magnitude part and the angle part of each complex number coefficient from rectangular to polar conversion means 130 is applied to the input of logarithmic conversion means 140. Logarithmic conversion means 140 operates only upon the magnitude part of the complex number coefficients it receives. This magnitude part M is applied to addressing means 141 which addresses logarithm look-up table 142. Together addressing means 141 and logarithm look-up table 142 operate in a manner similar to addressing means 134 and square root look-up table 135 described above. In this case addressing means 141 selects an address within logarithm look-up table 142 where data corresponding to the logarithm of the digital data word applied to addressing means 141 is stored. Thus the output of logarithm look-up table 142 and of logarithm conversion means 140 corresponds to the logarithm of the magnitude part of the complex number coefficient applied to logarithm conversion means 140.

Conversion from rectangular form to polar form is advantageous because of the nature of the response of the human ear to tonal sound. The human ear is relatively insensitive to phase angle. For this reason the angle part of the polar form complex number discrete Fourier transform coefficient can be represented by relatively fewer bits without loss of fidelity. In addition the human ear is logarithmically reponsive to sound amplitude. For this reason the same range of sound amplitude can be encoded without loss of fidelity by representing the logarithm of the magnitude part by fewer bits than would be otherwise required. It has been found that the same signal requiring 14 bit data words for faithful representation in the time domain can be represented with equal fidelity in the frequency domain using only 10 bit data words, six bits for the magnitude and four bits for the angle.

The output of logarithm conversion means 140 is applied to digital filter 150. Digital filter 150 operates as a frequency filter. Digital filter 150 includes adder 151, counter 152, addressing means 153 and frequency coefficient look-up table 154. Note that only that the log magnitude part of the complex number coefficient is operated upon by digital filter 150. This log magnitude part is applied to one input of adder 151. The other input of adder 151 is derived as follows. A counter 152 which is in synchronism with the data transfer rate between logarithm look-up table 140 and digital filter 150 drives addressing means 153. The output of Fourier transform means 120 is organized in such a way that the complex number discrete Fourier transform coefficients output therefrom are in a predetermined repeating order in accordance with their corresponding frequencies. Counter 152 has a count capacity equal to the number of selected frequencies at which complex number discrete Fourier transform coefficients are calculated. Thus the count of counter 152, which is in synchronism with the data transfer rate of the system, is indicative of the corresponding frequency of the currently received complex number coefficient from logarithm conversion means 140. Addressing means 153 receives the count of counter 152 and selects an address within frequency coefficient look-up table 154 corresponding to the currently received complex number coefficient. The output from look-up table 154 is applied to the other input of adder 151, which thereby modifies the magnitude part of the received complex number coefficient. The output of adder 151 is the output of digital filter 150. Please note, that by adding a number to the logarithm magnitude part, this is equivalent to multiplying a linear magnitude part by a predetermined factor.

The output of digital filter 150 is applied either to memory 160 or communications channel 170. If the system 100 is employed for storing digital data for later reproduction then the data output from digital filter 150 is applied to a memory 160. This memory 160 may be a permanent memory such as variations in the grooves of a permanently set disk, or it may be a rewritable memory such as a magnetic recording medium. This magnetic recording medium may be a computer magnetic disk, a reel-to-reel, cartridge or cassette tape. In the case in which encoding system 100 is employed for communications, the output of digital filter 150 is applied to communications channel 170 for transmission to the appropriate receiving station.

FIG. 5 illustrates a decoding device for decoding the digital musical signal in accordance with the teachings of the present invention. This decoding device 200 includes digital filter 210, antilogarithm conversion means 220, polar to rectangular conversion means 230, inverse Fourier transform means 240 and digital-to-analog conversion means 250. Digital filter 210 receives digital data inputs at input 201 either from an appropriate reading means from a memory such as memory 160 illustrated in FIG. 1 or from a communications channel such as communications channel 170 illustrated in FIG. 1. Digital filter 210 operates as a frequency filter in much the same manner as digital filter 150 illustrated in FIG. 1. The filtered digital data words from digital filter 210 are applied to antilogarithm conversion means 220. Antilogarithm conversion means 220 converts the logarithmic magnitude data into linear data in an operation which is the inverse of the operation of logarithmic conversion means 140 illustrated in FIG. 1. The thus converted digital data is applied to polar to rectangular conversion means 230. Polar to rectangular conversions means 230 changes the polar form complex number coefficients received from antilogarithm conversion means 220 into rectangular form. This operation is the inverse of the operation performed by rectangular to polar conversion means 130 illustrated in FIG. 1. The rectangular form complex number coefficients from polar to rectangular conversion means 230 are applied to inverse Fourier transform means 240. Inverse Fourier transform means 240 converts the discrete Fourier transform coefficients at the selected frequencies received from polar to rectangular conversion means 230 into the time domain. The output of inverse Fourier transform means 240 is a set of time domain digital data words, each digital data word having a value corresponding to the magnitude of an analog signal. Inverse Fourier transform means 240 performs the inverse operation of Fourier transform means 120 illustrated in FIG. 1. The time domain digital data words from inverse Fourier transform means 240 are applied to digital to analog conversion means 250. Digital to analog conversion means 250 receives the time domain sampled digital data words from inverse Fourier transform means 240 and generates an analog signal corresponding thereto. This operation is the inverse of the operation performed by analog to digital converter 110 illustrated in FIG. 1. Digital to analog conversion means 250 generates an analog output at output 202.

Digital filter 210 operates in a manner similar to digital filter 150 illustrated in FIG. 1 and described above. Digital filter 210 receives digital data words at digital data input 201. These digital data words may either be from appropriate read-out of a memory such as memory 160 or may be received from a communications channel such as communications channel 170. These input digital data words are applied to one input of adder 211. Counter 212 is synchronism with the rate of reception of data words at digital data input 201. This synchronism is achieved either by synchronization with the means reading out the memory 160 or by receiving and detecting a synchronous signal accompanying the digital data words on communications channel 170. The count of counter 212 is applied to addressing means 213. In a manner described above in conjunction with digital filter 150, addressing means 213 selects an address within frequency coefficient look-up table 214 which corresponds to the currently received frequency. This frequency coefficient is applied to the other input of adder 211. A manner similar to that described in conjunction with digital filter 150, this addition modifies the magnitude of the polar form complex number of coefficients applied to digital data input 201. The output of adder 211 is the output of digital filter 210.

Antilogarithmic conversions means 220 receives the modified polar form complex number coefficients generated by digital filter 210 and converts the logarithmic magnitude part of each polar form complex number coefficient back into linear form. Antilogarithmic conversion means 220 includes addressing means 221 and antilogarithm look-up table 222. In a manner described in conjunction with previous combinations of addressing means and look-up tables, the addressing means 221 generates an address which corresponds to the received magnitude part of the complex number. Antilogarithm look-up table 222 stores a data word at this location which corresponds to the antilogarithm of the received magnitude part. This antilogarithm digital data word is read out of antilogarithm look-up table 222 when the address is applied thereto via addressing means 221. The output of antilogarithm look-up table 222 is the output of antilogarithm conversion means 220.

Polar to rectangular conversion means 230 receives the digital data words output from antilogarithm conversion means 222 and converts these polar form complex numbers into rectangular form. Polar to rectangular conversion means 230 includes addressing means 231, cosine look-up table 232, multiplier 233, addressing means 234, sine look-up table 233 and multiplier 236. The angular part of the polar form complex number A is applied to addressin means 231. Addressing means 231 selects an appropriate address corresponding to the received angular part digital data word for application to cosine look-up table 232. Cosine look-up table 232 outputs a digital data word corresponding to the cosine of the angular part A received by addressing means 231. This cosine term is applied to one input of multiplier 233. The magnitude part of the complex number M is applied to the other input of multiplier 233. Therefore the output of multiplier 233 is the real part of a rectangular form complex number in accordance with the formula $R=M \cos A$. In a similar manner the angular part of the polar form complex number is applied to addressing means 234 which causes sine look-up table 235 to output a digital data word corresponding to the sine of the angular part A applied to addressing means 234. This sine term is applied to one input of multiplier 236 which receives the magnitude part M at the other input. Thus the output of multiplier 236 is the imaginary part I in accordance with the formula $I=M \sin A$.

Figure 6:
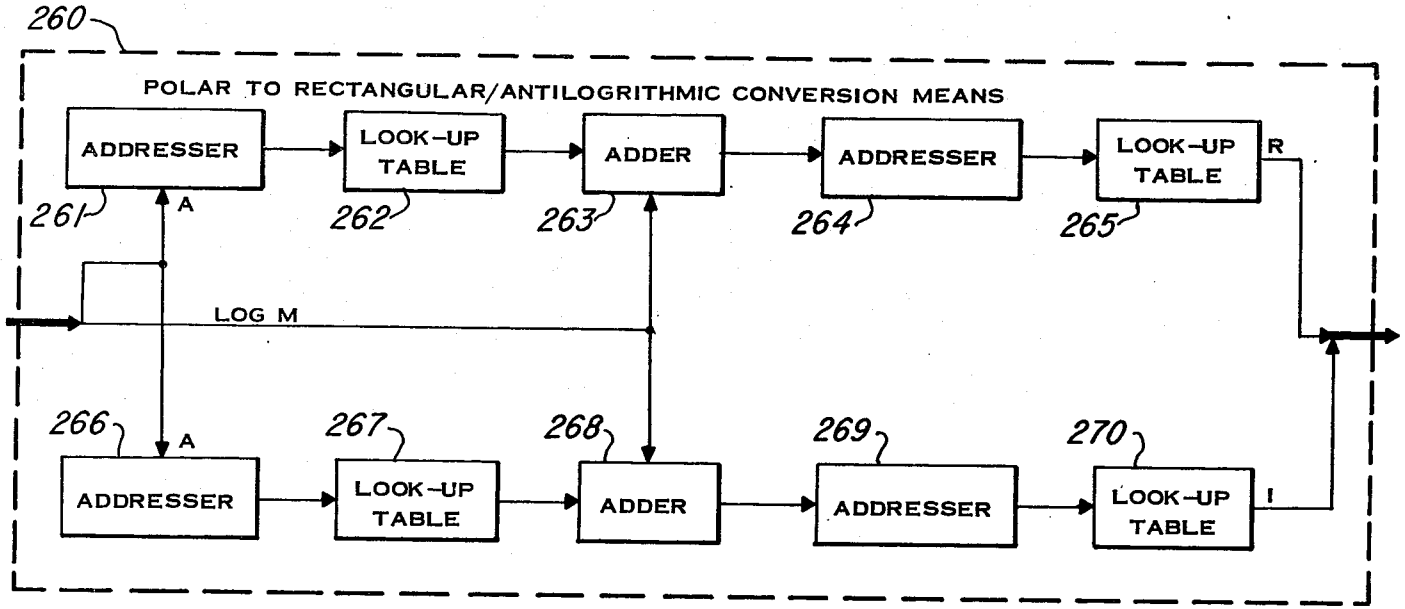
FIG. 6 is a block diagram illustrating a combined polar to rectangular/antilogarithmic conversion means which may be substituted for antilogarithmic conversion means 220 and polar to rectangular conversion means 230 illustrated in FIG. 5.

FIG. 6 illustrates polar to rectangular/antilogarithmic conversion means 260 which can be used to replace both antilogarithmic conversion means 220 and polar to rectangular conversion means 230 illustrated in FIG. 5. Polar to rectangular/antilogarithmic conversion means 260 includes addresser 261, look-up table 262, adder 263, addresser 264, look-up table 265, addresser 266, look-up table 267, adder 268, addresser 269 and look-up table 270. The angle part A of the polar form complex number is applied to both addressers 161 and 166. Addresser 161 selects an address within look-up table 262 corresponding to the received angle part. The data stored at this location corresponds to the logarithm of the cosine of the angle A. Similarly, addresser 266 picks an address within look-up table 267 corresponding to the received angle part A. Stored at this location is data corresponding to the logarithm of the sine of the angle A. The data from look-up table 262 is applied to one input of adder 263 which also receives the logarithm of the magnitude part M. Similarly, the output of look-up table 267 is applied to one input of adder 268 which also receives the logarithm of the magnitude part M. The sum output from adder 263 is applied to addresser 264 which selects an appropriate address within look-up table 265. The data at the selected address within look-up table 265 corresponds to the antilogarithm of the output from adder 263. Similarly, the sum output from adder 268 is applied to addresser 269 for selection of the appropriate location within look-up table 270. As in the case of look-up table 265, look-up table 270 stores data corresponding to the antilogarithm of the sum output from adder 268. Polar to rectangular/antilogarithmic conversion means 260 thus calculates the real part R in accordance with the formula $R=\text{antilog}(\log M+\log\cos A)$. Similiarly, polar to rectangular/antilogarithmic conversion means 260 calculates the imaginary part I in accordance with the formula $I=\text{antilog}(\log M+\log\sin A)$. Calculation of the rectangular coordinates in this manner results in replacing multipliers 233 and 236 of polar to rectangular conversion means 230 with adders 263 and 268 in polar to rectangular/antilogarithmic conversion means 260. This substitution greatly reduces the computational requirements for calculation of the rectangular coordinates. The difference between the trigonometric look-up tables 232 and 235 and the logarithmic of the trigonometric look-up tables 262 and 267 is solely in the specific data within these tables and thus no additional computation is required.

Inverse Fourier transform 240 receives the rectangular form complex numbers from polar to rectangular conversion means 230 and converts this data into the time domain. As in the case of Fourier transform means 120, due to the computational requirements for converting the input frequency domain data into the time domain, inverse Fourier transform means 240 includes a number of discrete Fourier transforms represented by discrete Fourier transforms 241, 242 and 243. An interesting and useful feature of the discrete fast Fourier transform mathematical technique is that this mathematical technique is completely reciprocal. That is, the same matrix mathematics can be used to convert time sampled time domain data into the frequency domain and for converting frequency sampled frequency domain data into the time domain. Therefore, each discrete Fourier transform 241, 242 and 243 is identical to and performs the same mathematical functions as the discrete Fourier transforms 121, 122 and 123 illustrated in FIG. 1. The output of this group of discrete Fourier transforms is a set of digital data words each corresponding to the magnitude of an analog signal at a selected time. This set of digital data words corresponds to the digital data word output from analog to digital converter means 110, with the exception of the frequency filtering influences of digital filter 150 and digital filter 210.

The time domain digital data words from inverse Fourier transform means 240 are applied to digital to analog conversion means 250. Digital to analog conversion means 250 converts these received digital data words into an analog signal output at analog signal output 202. Digital to analog conversion means 250 includes register 251, a number of current drive means represented by currents drives 252, 253 and 254, analog summing amplifier 255 and low pass filter 256. Each received digital data word is applied in parallel to register 251, which stores an entire digitial data word therein. Each individual bit of the digital data word 251 is applied to one of the group of current drives illustrated by current drives 252, 253 and 254. The state of the corresponding bit stored in register 251 determines whether the respective current drive is active or inactive. Note that the amount of current generated by the respective current drives when active corresponds to the particular digit represented. Thus current drive 251 generates a unit current, current drive 253 generates a two unit current, and current drive 254 generates a current having $2^N$ units, where N is the number of bits of the digital data word stored in register 251. Each of the currents produced by current drives 252, 253 and 254 are applied to analog summing amplifier 255. The output of analog summing amplifier 255 has a magnitude corresponding to the value of the digital data word stored in register 251. This analog output is applied to low pass filter 256, which serves to filter out any switching transients between consecutive digital data words applied to register 251. The output of filter 256 is applied to output 202. This output corresponds substantially to the analog input applied to input 101, with the exception of the filtering features of digital filter 150 and digital filter 210.

FIG. 8 illustrates the selected frequencies of the frequency domain coefficients for the Fourier transform means 120 illustrated in FIG. 1 and the inverse Fourier transform means 240 illustrated in FIG. 5. It is well known that the human ear generally distinguishes musical tones on the basis of percentage frequency difference. Thus the human ear has approximately the same tonal resolution in each octave. By taking advantage of this limitation in the analytical capacity of the human hearing system, the number of frequencies at which discrete Fourier transform coefficients are required can be greatly reduced. The general scheme of the present invention is to provide discrete Fourier transform coefficients at sets of frequencies which are octavely related.

FIG. 8 illustrates a frequency spectrum on a logarithmic scale, that is each octave occupies the same linear space as each other octave. This logarithmic scale approximates the resolution capacity of the human ear as noted above. This frequency spectrum includes primary octave 401 and secondary octaves 402, 403, and 404. Each frequency set includes a primary frequency within the primary octave and secondary frequencies within each of the secondary octaves. Note that primary frequency 411 falls within the primary octave 401. Primary frequency 411 has associated therewith secondary frequencies such as secondary frequency 412 within secondary octave 402, secondary frequency 413 within secondary octave 403 and secondary frequency 414 within secondary octave 404. Primary frequency 421 also falls within the primary octave 401. Primary frequency 421 has secondary frequencies 422, 432, and 424 which are octavely related thereto. Similiarly, primary frequency 431 has octavely related frequencies 432, 433, and 434 associated therewith. A similar relationship holds between primary frequency 441 and secondary frequencies 442, 443, and 444. Note that the primary frequencies 411, 421, 431 and 441 are equally spaced on a percentage basis within primary octave 401. Thus the secondary frequencies within each secondary octave are also spaced at equal percentage frequency intervals throughtout the respective secondary octaves. Thus the selected frequencies at which discrete Fourier transform coefficients are calculated are equally spaced on a percentage frequency basis throughout the frequency spectrum of interest. This equal percentage dispersion throughout the frequency spectrum of interest approximates the response of the human hearing system to tonal sounds. According to the present scheme there are fewer discrete Fourier transform coefficients calculated for frequencies in the higher octaves than heretofore known, however, the omission of these additional frequencies does not degrade the fidelity of the reproduced musical tones because the human hearing system is relatively insensitive to these additional frequencies at the upper octaves.

FIG. 9 illustrates a preferred embodiment of the selection of the primary frequencies for the primary octave. It should be understood that each secondary octave (not illustrated in FIG. 9) includes a similar dispersion of secondary frequencies related to the illustrated primary frequencies. FIG. 9 illustrates primary octave 401 and a group of primary frequencies distributed throughout the primary octave. In the case of the embodiment illustrated in FIG. 9, there are twelve primary frequencies 501 to 512 which are equally distributed throughout the primary octave. In this case each of the twelve primary frequencies 501 to 503 corresponds to the frequency of the twelve musical notes within primary octave 401. Thus primary frequency 501 corresponds to the musical note A, primary frequency 502 corresponds to the musical note B flat, primary frequency 503 corresponds to the musical note B, and so forth throughout the primary octave. Note that because each of the primary frequencies 501 through 512 has a number of secondary frequencies at different octaves associated therewith, FIG. 9 illustrates a frequency selection scheme in which a discrete Fourier transform coefficient is calculated for frequencies corresponding to each musical note through out the spectrum of interest. This selection of frequencies for calculation of discrete Fourier transform coefficients is particularly advantageous because, firstly, as explained above the human hearing system is responsive only to percentage frequency differencies, and, secondly, the selected frequencies at which the discrete Fourier transform coefficients are calculated corresponds to the exact frequencies at which the greatest amount of energy is expected when musical signals are encoded.

FIGS. 10 and 11 illustrate a portion of the primary octave corresponding to the musical notes B and C illustrating an improved scheme for selecting the frequencies at which discrete Fourier transform coefficients are to be calculated. It is generally known that musical instruments do not generate sharp frequency envelopes corresponding exactly to the frequency of the played musical note, but rather are known to generate rather broader spectrum corresponding generally to the frequencies near the frequency corresponding to the played musical note. Specifically some instruments such as pianos and pipe organs which employ more than one frequency generator for each musical note are deliberately tuned to generate a broadened frequency spectrum by having one or more frequency generators elements tuned below the frequency corresponding to the musical note and one or more frequency generator elements tuned to frequencies greater than the frequency corresponding to the musical note. For such instruments the frequency selection scheme illustrated in FIG. 8 may not convey all of the useful information necessary for high fidelity reproduction of musical signals. The two schemes illustrated in FIGS. 10 and 11 are intended to enable more accurate sampling and reproduction of such broadened tone musical signals.

FIG. 10 illustrates a portion of the prime octave including the musical notes B and C. The potential energy near the frequency of musical notes B is illustrated by the envelope 601. The potential energy near the frequency of the musical note C is illustrated by the envelope 602. Note that there are three selected frequencies for each of the illustrated musical notes B and C. Corresponding to musical note B is primary frequency 610 equal to the frequency of the musical note, primary frequency 611 less than the frequency of the musical note and primary frequency 612 greater than the frequency of the musical note. Similarly there are three primary frequencies corresponding to the musical note C. These are primary frequency 620 equal to the frequency of the musical note, primary frequency 611 less than the frequency of the musical note and primary frequency 622 which is greater than the frequency of the musical note. It is proposed that a group of three primary frequencies be distributed within the potential energy envelope for each musical note within the primary octave such as illustrated for the two primary notes B and C in FIG. 10. Thus the primary octave would contain thirty six primary frequencies. Because each of these primary frequencies has a group of secondary frequencies associated therewith, each musical note throughout the frequency spectrum of interest would have a group of three frequencies at which discrete Fourier transform coefficients are calculated.

FIG. 11 is similiar to FIG. 10 except that FIG. 11 illustrates a pair of primary frequencies for each of the musical tones B and C. FIG. 11 illustrates potential energy envelopes 701 corresponding to the primary octave musical note B and 702 corresponding to the primary octave musical note C. Both musical notes B and C have two primary frequencies associated therewith. Musical note B has associated therewith primary frequency 711, which is less than the frequency of the musical note and primary frequency 712, which is greater than the frequency of the musical note. Similarly, primary frequency 721 which is less than the frequency than the musical note and primary frequency 722 which is greater than the frequency of the musical note are associated with the musical note C. Thus each of the twelve musical notes within the primary octave have two primary frequencies associated therewith, thereby making twenty four total primary frequencies. As in the scheme illustrated in FIG. 6 there are secondary frequencies relating to the illustrated primary frequencies throughout the frequency spectrum of interest. Thus according to the scheme illustrated in FIG. 11, each musical note within the spectrum of interest has two frequencies at which discrete Fourier transform coefficients are calculated associated therewith.

Fourier transform means 120 can be constructed in accordance with the above described principles of selecting the frequencies at which discrete Fourier transform coefficients are calculated to minimize the data calculation requriements. This can be accomplished by providing one discrete Fourier transform, such as discrete Fourier transform means 121, 122 and 123 illustrated in FIG. 1, for each primary frequency. Each of these discrete Fourier transforms would operate upon differing numbers of sampled digital data words from analog to digital converter 110. As noted above, the smallest frequency resolution of the output from a discrete Fourier transform is related to the time length sampled, and therefore to the number of samples applied to the discrete Fourier transform. Ordinarily, a discrete Fourier transform would then permit generation of discrete Fourier transform coefficients at the lowest frequency of resolution and at all integral multiplies of that frequency. By providing a discrete Fourier transform for each of the primary frequencies, each of these discrete Fourier transforms being responsive to a predetermined number of digital data word samples from analog to digital converter 110 corresponding to its primary frequency, it is not necessary to require a discrete Fourier transform to operate on an extremely large number of data word samples in order to provide frequency resolution corresponding to each frequency within the primary octave. In addition, each of these discrete Fourier transforms is also capable of generating the discrete Fourier transform coefficients for secondary frequencies octavely related to their respective primary frequencies. Calculation of discrete Fourier transform coefficients at frequencies other than those octavely related to the primary frequency of the particular discrete Fourier transform is inhibited by omiting the matrix operations necessary for calculating these coefficients.

The above described technique will become clear from the description of a concrete example below. Refering to FIG. 9, it is noted that the lowest primary frequency at which a discrete Fourier transform coefficient is required to be calculated is 27.5 Hz. Assuming a sample data rate of 44 KHz it is necessary to employ 1600 samples to provide resolution at this frequency. Thus a basic data block of 1600 digital data words would be applied to Fourier transform means 120. Discrete Fourier transforms for other higher primary frequencies at higher frequencies would be responsive to a number of consecutive digital data words fewer than the 1600 data words forming the basic data block. For example, in order to provide resolution at the frequency of 30.9 Hz corresponding to the musical note B, 1424 consecutive digital data words would be employed. The discrete Fourier transform corresponding to the primary frequency 30.9 KHz thus should be made responsive to 1424 consecutive digital data words from analog to digital converter 110 during each cycle of 1600 digital data words, and not responsive to the other data words. This set of 1424 consecutive digital data words can be anywhere within the basic data block of 1600 digital data words. Similarly, the discrete Fourier transform having a primary frequency of 32.7 Hz corresponding to the musical note C should be responsive 1346 consecutive digital data words within the data block of 1600 data words. Assuming that a frequency selection scheme such as illustrated in FIG. 10 is employed using a deviation from the center frequency of approximately 0.5%, frequency 611 would be approximately 30.7 Hz requiring 1431 samples. Frequency 610 would be approximately 30.9 Hz requiring 1424 samples, frequency 612 would be 31.1 Hz requiring 1417 samples, frequency 621 would approximately 32.5 Hz requiring 1353 samples, frequency 620 would be approximately 32.7 Hz requiring 1346 samples, and frequency 622 would be approximately 32.8 Hz requiring 1339 samples. Similarly, if a frequency selection scheme such as illustrated in FIG. 11 was selected using a frequency deviation of 0.3%, frequency 711 would be approximately 30.8 Hz requiring 1424 samples, frequency 712 would be approximately 31.0 Hz requiring 1420 samples, frequency 721 would be approximately 32.6 Hz requiring 1350 samples, and frequency 722 would be approximately 32.8 Hz requiring 1342 samples.

The data rate advantage of the present invention can be shown by a few simple calculations. Assume that the frequency selection scheme illustrated in FIG. 10 is used, whereby each musical tone has 3 selected frequencies associated therewith, for a musical scale of 10 octaves. There are thus 36 selected frequencies per octave for a total of 360 selected frequencies. For a 2 channel stereo system there would be 720 complex number discrete Fourier transform coefficients of 10 bits each (6 bits for the log magnitude and 4 bits for the angle). These complex number discrete Fourier transform coefficients would be calculated and transmitted approximately 20 times per second assuming the primary octave begins at about 20 Hz. This makes a total data rate of about 144 thousand bits per second. This is almost an order of magnitude less than the 1.23 to 1.4 million bits per second required by the prior art technique. It is believed this order of magnitude reduction in data rate makes the present tecnique highly advantageous for a wide range of memory prices and communications bandwidth requirements even in light of the additional computational requirements of the present invention.

It should be clear to those skilled in the art that the present invention is equally applicable to a two channel stereo system or a four channel quadrophonic system without extensive modification. It should also be clear that some of the components of both the encoding apparatus 100 and the decoding apparatus 200 could be shared in a multichannel system by appropriate time shared data separation. For example, by proper addressing the functions of look-up tables 232 and 235 may be combined. Similiarly, look-up tables 262 and 267 may be combined.

Figure 12:
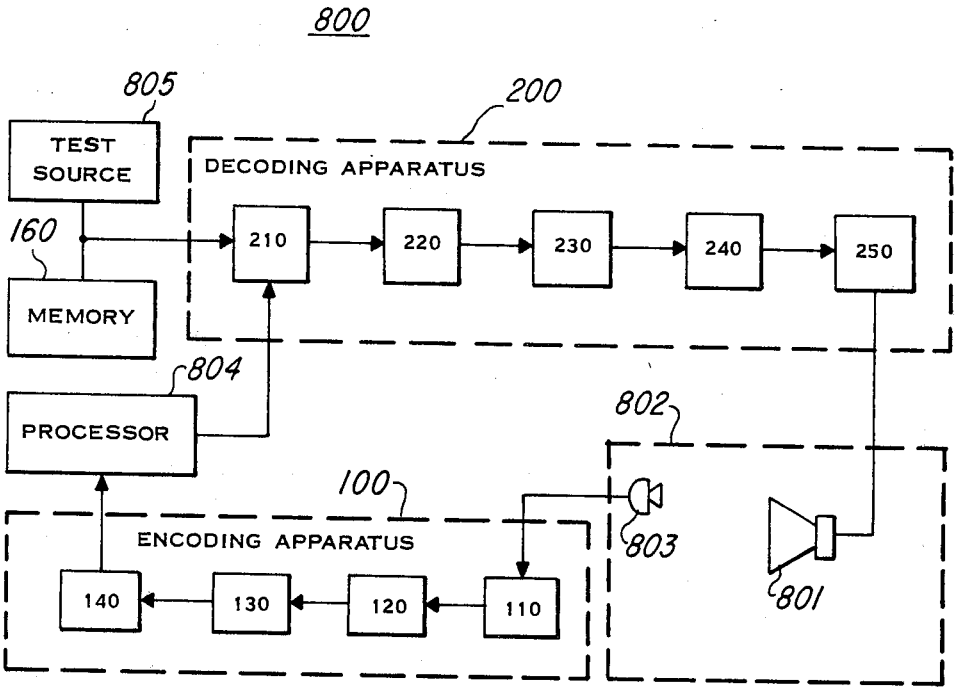
FIG. 12 illustrates a preferred embodiment of a system for generating inverse filter coefficients for cancellation of room acoustics in accordance with the teachings of the present invention.

FIG. 12 illustrates a preferred embodiment for generating inverse filter coefficients for the cancellation of the room acoustics in a musical signal play back system. FIG. 8 illustrates a memory 160, such as illustrated in FIG. 1 which is connected to a decoding apparatus 200 substantially as illustrated in FIG. 5. Decoding means 200 includes digital filter 210, antilogarithm look-up table 220, polar to rectangular conversion means 230, inverse Fourier transform means 240 and digital to analog conversion means 250. Digital to analog conversion means 250 is connected to a sound reproducing means such as speaker 801 illustrated in FIG. 12. Speaker 801 is disposed at an operating position within room 802. Also disposed within room 802 is a microphone 803 which is placed at the preferred listening position. Microphone 803 is connected to an encoding apparatus 100, substantially as shown in FIG. 1 Encoding apparatus 100 includes analog to digital conversion means 110, Fourier transform means 120, rectangular to polar conversion means 130 and logarithmic conversion means 140. The output of logarithmic conversion means 140 is connected to a processor 804, which operates in a manner to be further described below.

Memory means 160 has stored therein a particular test program to enable the system illustrated in FIG. 8 to cancel the room acoustics of room 802. This sort of test data would ordinarily include one or more signals which include substantial acoustical energy throughout the frequency spectrum of interest. As an alternative to providing a test recording on memory 160, it is possible to provide a test source 805 which is connected to digital filter 210 to generate this test signal. Test source 805 would preferably generate a series of the same digital data words. Since these digital data words are recognized as polar form complex number discrete Fourier transfer coefficient by the decoding apparatus 200, a provision of equal test words from test source 805 would be interpreted as a "white noise" signal having equal energy at each of the selected frequencies of the decoding apparatus 200. This test signal is transmitted into listening room 802 by speaker 801. Microphone 803 receives this test signal as modified by the acoustics of listening room 802. This signal was processed by encoding apparatus 100 and the output of logarithmic conversion means 140 is applied to processor 804. In the event that the test sound has equal energy at each of the selected frequencies, any deviation from equal energy at the output of logarithmic conversion means 140 is due to room acoustics. Processor 804 receives the polar form complex number discrete Fourier transform coefficients from logarithmic look-up table 140 and calculates the inverse of each magnitude part for each selected frequency. This set of inverse magnitude parts is then entered into look-up table 214 which is a part of digital filter 210. For this application look-up table 214 must be either a random access memory (RAM) or an erasable programmable read-only memory (EPROM).

With the particular frequency coefficients thus entered into digital filter 210, the decoding apparatus 200 causes speaker 801 to emit a different signal into listening room 802 than is applied to digital filter 210. In this case the acoustical characteristics of listening room 802 are cancelled out by the operation of digital filter 210 when the contents of look-up table 214 are specified in the manner described. Thus, for example, if listening room 802 has a "dead spot" at a particular frequency at the location of microphone 803, this would be sensed by the system illustrated in FIG. 8 and an appropriate correction would be made by a digital filter 210. This explanation would apply equally well for a "hot spot" in which the acoustical characteristics of listening room 802 causes increased amplitude at a particular frequency at the location of microphone 803.

Figure 13:
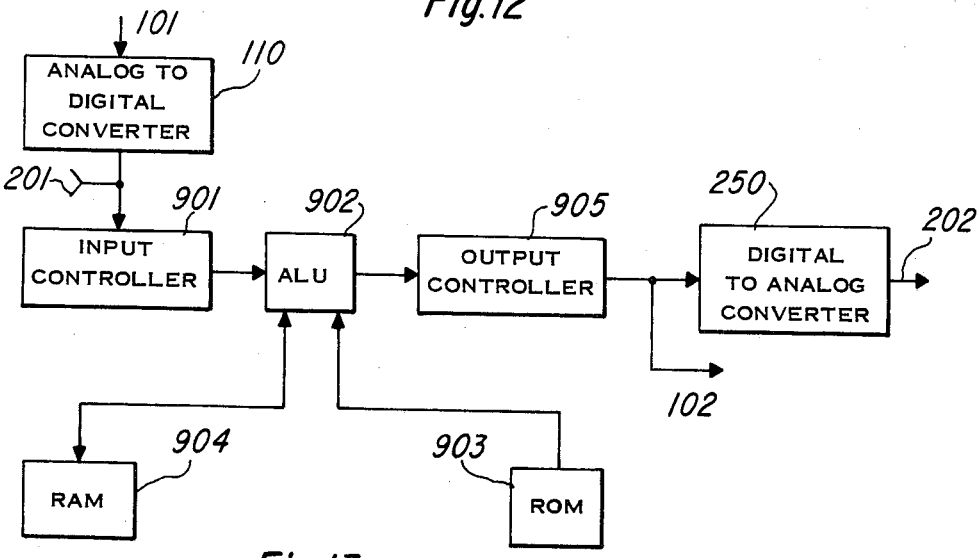
FIG. 13 illustrates an embodiment of the present invention in which substantial portions of the digital signal processing in accordance with the teachings of the present invention are performed by a programmed digital computer.

FIG. 13 illustrates an alternative embodiment which is capable of performing the functions of the encoding means 100 illustrated in FIG. 1 and/or the decoding means 200 illustrated in FIG. 5. System 900 illustrated in FIG. 13 includes analog to digital conversion means 110 such as illustrated in FIG. 1. The data words generated by analog to digital conversiion means 110 are applied to an input controller means 901 and hence to an arithmetic logic unit 902. The arithmetic logic unit 902 performs logical functions under the control of a program permanently stored in a read only memory 903. Read only memory 903 can be permanently programmed to cause arithmetic logic unit 902 to perform the functions of Fourier transform means 120, rectangular to polar conversion means 130, logarithmic conversion means 140 and digital filter 150 and may be further programmed to cause arithmetic logic unit 902 to perform the functions of digital filter 210, antilogarithmic conversion means 220, polar to rectangular conversion 230 and inverse Fourier transform means 240. Under the control of the program stored in read only memory 903, arithmetic logic unit 902 may temporarily store intermediate data in random access memory 904. The arithmetic unit 902 periodically accesses the intermediate data stored in random access memory 904 in accordance with the program stored in read only memory 903 in order to calculate further intermediate data. The results of the logical operations of arithmetic logic unit 902 are applied to output means 903 and hence to digital to analog conversion means 280. Due to the large amount of calculation required in this system, the arithmetic logic unit 902 must be an extremely high speed device in order to perform the above described manipulations of the musical signal data in real time. However, this configuration enables rapid change of the particular algorithm implemented, especially rapid change of the filter coefficients within digital filter 150 and digital filter 210 by merely changing the program stored in read-only memory 903. In addition, it is possible to make arithmetic logic unit 902 responsive to a user generated program which may be stored in a portion of random access memory 904. Thus it may be possible to enable a user to alter the filter coefficients within digital filter 150 or digital filter 210 by merely changing the data stored within random access memory 904. The apparatus 900 illustrated in FIG. 13 is thus an extraordinarily flexible digital signal processing apparatus.

What is claimed is:

1. An apparatus for communicating musical signals comprising;

analog to digital conversion means for receiving an analog signal representing a musical signal and converting the analog signal into a corresponding plurality of first digital data words, each of the first digital data words representing the amplitude of the audio signal at a corresponding one of a plurality of sampling intervals;

Fourier transform means connected to the analog to digital conversion means for converting successive selected sets of successive first digital data words into corresponding sets of a plurality of second digital data words, each of the second digital data words representing a complex number discrete Fourier transform coefficient of a corresponding frequency of at least one set of frequencies, each set of frequencies including a primary frequency and only frequencies octavely related thereto and excluding harmonics which are not octavely related to said primary frequency, communication means connected to the Fourier transform means for transmission of digital data words applied thereto;

inverse Fourier transform means connected to the communication means for converting sets of digital data words transmitted by the communication means into successive sets of third digital data words, each third digital data word representing the amplitude of an analog signal at a corresponding one of a plurality of sampling intervals; and digital to analog conversion means converted to the inverse Fourier transform means for converting the plurality of third digital data words into a corresponding analog signal.

2. An apparatus for communicating musical signals as claimed in claim 1 further comprising:

rectangular to polar conversion means connected between the Fourier transform means and the communication means for converting each of the second digital data words into polar form wherein the complex number discrete Fourier transform coefficient has a magnitude part and an angle part; and polar to rectangular conversion means connected between the communication means and the inverse Fourier transform means for converting each digital data word recalled from the memory means into rectangular form wherein the complex number discrete Fourier transform coefficient has a real part and an imaginary part.

3. An apparatus for communicating musical signals as claimed in claim 2 wherein:

the rectangular to polar conversion means includes means for converting each of the second digital data words into polar form having a magnitude part with a first predetermined number of bits and an angle part with a second predetermined number of bits, said first predetermined number being greater than said second predetermined number.

4. An apparatus for communicating musical signals a claimed in claim 2, further comprising:

logarithmic conversion means connected between the rectangular to polar conversion means and the communication means for converting the magnitude part of each second digital data word into the logarithm thereof; and antilogarithmic conversion means connected between the communication means and the polar to rectangular conversion means for converting the magnitude part of each digital data word read out of the memory into the antilogarithm thereof.

5. An appartus for communicating musical signals as claimed in claim 2, further comprising:

filter means connected between the rectangular to polar conversion means and the communication means for modifying the magnitude part of each second digital data word by a selected amount related to the corresponding frequency of the second digital data word.

6. An apparatus for communicating musical signals as claimed in claim 2, further comprising:

filter means connected between the communication means and the polar to rectangular conversion means for modifying the magnitude part of each second digital data word by a selected amount related to the corresponding frequency of the second digital data word.

7. An apparatus for communicating musical signals as claimed in claim 1, wherein:

said Fourier transform means comprises a plurality of discrete Fourier transform means corresponding to respective ones of a plurality of primary frequencies, each discrete Fourier transform means responsive to successive sets of a predetermined number of first digital data words, said predetermined number equal to the inverse of the product of the length of the sampling internal and the primary frequency, and each discrete Fourier transform means converting said sets of first digital data words into second digital data words representing complex number discrete Fourier transform coefficients at said respective primary frequencies and said frequencies octavely related thereto.

8. An apparatus for communicating musical signals as claimed in claim 1, wherein:

said Fourier transform means includes means for generating second digital data words representing discrete Fourier transform coefficients at corresponding sets of frequencies wherein the primary frequency of each of the sets of frequencies corresponds to a selected musical note.

9. An apparatus for communicating musical signals as claimed in claim 8, wherein:

said means for generating second digital data words further includes means wherein said at least one set of frequencies comprises twelve sets of frequencies and the primary frequency of each of the sets of frequencies corresponds to a different musical note of a primary octave.

10. An apparaatus for communicating musical signals as claimed in claim 1, wherein:

said Fourier transform means includes means for generating second digital data words representing discrete Fourier transform coefficients at corresponding sets of frequencies wherein the primary frequency of each of the sets of frequencies is within a predetermined frequency range of an associated musical note.

11. An apparatus for communicating musical signals as claimed in claim 10, wherein:

said means for generating second digital data words further includes means wherein each musical note of a primary octave has a predetermined number of primary frequencies associated therewith.

12. An appartus for communicating musical signals as claimed in claim 11, wherein:

said means for generating second digital data words further includes means wherein each musical note of the primary octave has associated therewith a first primary frequency a predetermined percentage less than the frequency of the musical note and a second primary frequency said predetermined percentage greater than the frequency of the musical note.

13. An apparatus for communicating musical signals as claimed in claim 11, wherein:

said means for generating second digital data words further includes means wherein each musical note of the primary octave has associated therewith a first primary frequency a predetermined percentage less than the frequency of the musical note, a second primary frequency equal to the frequency of the musical note and a third primary frequency the predetermined frequency greater than the frequency of the musical note.

14. An apparatus for communicating musical signals as claimed in claim 1, wherein:

said Fourier transform means includes means for generating second digital data words of corresponding sets of frequencies wherein a primary octave has a predetermined number of primary frequencies disposed at equal percentage frequency intervals associated therewith.

15. An apparatus for encoding musical signals comprising;

analog to digital conversion means for receiving an analog signal representing a musical signal and converting the analog signal into a corresponding plurality of first digital data words, each of the first digital data words representing the amplitude of the audio signal at a corresponding one of a plurality of sampling intervals; and Fourier transform means for converting successive selected sets of successive first digital data words into a corresponding sets of a plurality of second digital data words, each of the second digital data words representing a complex number discrete Fourier transform coefficient of a corresponding frequency of at least one set of frequencies, each set of frequencies including a primary frequency and only frequencies octavely related thereto and excluding harmonics which are not octavely related to said primary frequency.

16. An apparatus for encoding musical signals as claimed in claim 15, further comprising;

rectangular to polar conversion means connected to the Fourier transform means for converting each of the second digital data words into polar form wherein the complex number discrere Fourier transform coefficient has a magnitude part and an angle part.

17. An apparatus for encoding musical signals as claimed in claim 16 wherein:

the rectangular to polar conversion means includes means for converting each of the second digital data words into polar form having a magnitude part with a first predetermined number of bits and an angle part with a second predetermined number of bits, said first predetermined number being greater than said second predetermined number.

18. An apparatus for encoding musical signals as claimed in claim 16 further comprising:

logarithmic conversion means connected between the rectangular to polar conversion means and the communication means for converting the mangitude part of each second digital data word into the logarithm thereof.

19. An apparatus for encoding musical signals as claimed in claim 16, further comprising:

filter means connected to the rectangular to polar conversion means for modifying the magnitude part of each second digital data word by a selected amount related to the corresponding frequency of the second digital data word.

20. An apparatus for encoding musical signals as claimed in claim 1, wherein:

said Fourier transform means comprises a plurality of discrete Fourier transform means corresponding to respective ones of a plurality of primary frequencies, each discrete Fourier transform means responsive to successive sets of a predetermined number of first digital data words, said predetermined number equal to the inverse of the product of the length of the sampling interval and the primary frequency, and each discrete Fourier transform means converting said sets of first digital data words into second digital data words representing complex number discrete Fourier transform coefficients at said respective primary frequency and said frequencies octavely related thereto.

21. An apparatus for encoding musical signals as claimed in claim 15, wherein:

said Fourier transform means includes means for generating second digital data words representing discrete Fourier transform coefficients at corresponding sets of frequencies wherein the primary frequency of each of the sets of frequencies corresponds to a selected musical note.

22. An apparatus for encoding musical signals as claimed in claim 21, wherein:

said means for generating second digital data words further includes means wherein the at least one set of frequencies comprises twelve sets of frequencies and the primary frequency of each of the sets of frequencies corresponds to a different musical note of a primary octave.

23. An apparatus for encoding musical signals as claimed in claim 15, wherein:

said Fourier transform means includes means for generating second digital data words representing discrete Fourier transform coefficients at corresponding sets of frequencies wherein the primary frequency of each of the sets of frequencies is within a predetermined frequency range of an associated musical note.

24. An apparatus for encoding musical signals as claimed in claim 23, wherein:

said means for generating second digital data words further includes means wherein each musical note of a primary octave has a predetermined number of primary frequencies associated therewith.

25. An apparatus for encoding musical signals as claimed in claim 24, wherein:

said means for generating second digital data words further includes means wherein each musical note of the primary octave has associated therewith a first primary frequency a predetermined percentage less than the frequency of the musical note and a second primary frequency said predetermined percentage greater than the frequency of the musical note.

26. An apparatus for encoding musical signals as claimed in claim 24, wherein:

said means for generating second digital data words further includes means wherein each musical note of the primary octave has associated therewith a first primary frequency a predetermined percentage less than the frequency of the musical note, a second primary frequency equal to the frequency of the musical note and a third primary frequency the predetermined frequency greater than the frequency of the musical note.

27. An apparatus for encoding musical signals as claimed in claim 15, wherein:

said Fourier transform means includes means for generating second digital data words representing discrete Fourier transform coefficients at corresponding sets of frequencies wherein a primary octave has a predetermined number of primary frequencies disposed at equal percentage frequency intervals associated therewith.

28. An apparatus for encoding musical signals as claimed in claim 15, further comprising:

memory writing means connected to the Fourier transform means and connectable to a memory means for storing second digital data words received from the Fourier transform means in a memory means.

29. An apparatus for decoding digital data words representing musical signals comprising:

receiving means for receiving first digital data words representing complex number discrete Fourier transform coefficients for at least one set of frequencies, said at least one set of frequencies including a primary frequency and only frequencies octavely related thereto and excluding harmonics which are not octavely related to said primary frequency;

inverse Fourier transform means connected to the receiving means for converting successive selected sets of said first digital data words into corresponding sets of second digital data words, each second digital data word representing the amplitude of an analog signal at a corresponding one of a plurality of sampling intervals; and digital to analog conversion means connected to the inverse Fourier transform means for converting the sets of second digital data words into a corresponding analog signal.

30. An apparatus for decoding digital data words representing musical signals as claimed in claim 29 further comprising:

polar to rectangular conversion means connected between the receiving means and the inverse Fourier transform means for converting each received first digital data word from polar form into rectangular form wherein the complex number discrete Fourier transform coefficient has a real part and an imaginary part.

31. An apparatus for decoding digital data words repesenting signals as claimed in claim 30 further comprising:

antilogarithmic conversion means connected between the receiving means and the polar to rectangular conversion means for converting the magnitude part of each received first digital data word into the antilogarithm thereof.

32. An apparatus for digital data words representing musical signals as claimed in claim 30 further comprising:

filter means connected between the receiving means and the polar to rectangular conversion means for modifying the magnitude part of each received first digital data word by a selected amount related to the corresponding frequency of the first digital data word.

33. An apparatus for digital data words representing musical signals as claimed in claim 29, wherein:

said inverse Fourier transform means includes means for generating second digital data words representing discrete Fourier transform coefficients at corresponding sets of frequencies wherein the primary frequency of each of the sets of frequencies corresponds to a selected musical note.

34. An apparatus for digital data words representing musical signals as claimed in claim 33, wherein:

said means for generating second digitial data words further includes means wherein the at least one set of frequencies comprises twelve sets of frequencies and the primary frequency of each of the sets of frequencies corresponds to a different musical note of a primary octave.

35. An apparatus for digital data words representing musical signals as claimed in claim 29, wherein:

said inverse Fourier transform means includes means for generating second digital data words representing discrete Fourier transform coefficients at corresponding sets of frequencies wherein the primary frequency of each of the sets of frequencies is within a predetermined frequency range of an associated musical note.

36. An apparatus for digital data words representing musical signals as claimed in claim 35, wherein:

said means for generating second digital data words further includes means wherein each musical note of a primary octave has a predetermined number of primary frequencies associated therewith.

37. An apparatus for digital data words representing musical signals as claimed in claim 36 wherein:

said means for generating second digital data words further includes means wherein each musical note of the primary octave has associated therewith a first primary frequency a predetermined percentage less than the frequency of the musical note and a second primary frequency the predetermined percentage greater than the frequency of the musical note.

38. An apparatus for decoding digital data words representing musical signals as claimed in claim 36, wherein:

said means for generating second digital data words further includes means wherein each musical note of the primary octave has associated therewith a first primary frequency a predetermined percentage less than the frequency of the musical note, a second primary frequency equal to the frequency of the musical note and a third primary frequency the predetermined frequency greater than the frequency of the musical note.

39. An apparatus for decoding digital data words repesenting signals as claimed in claim 29, wherein:

said inverse Fourier transform means includes means for generating second digital data words representing discrete Fourier transform coefficients at corresponding sets of frequencies wherein a primary octave has a predetermined number of primary frequencies disposed at equal percentage frequency intervals associated therewith.

40. An apparatus for decoding digital data words representing musical signals as claimed in claim 29, further comprising:

memory reading means connected to the receiving means and connectable to a memory means for reading digital data words stored in a memory means and applying the read digital data words to the receiving means.

* * * * *